United States Patent [19]

Calleance

[11] 4,190,917

[45] Mar. 4, 1980

[54] BAFFLED WATERMATTRESS CONSTRUCTION

[76] Inventor: David Calleance, 1945 - 23rd Ave., San Francisco, Calif. 94116

[21] Appl. No.: 904,195

[22] Filed: May 9, 1978

[51] Int. Cl.[2] ..... A47G 9/00

[52] U.S. Cl. ..... 5/457; 5/451

[58] Field of Search ..... 5/349, 350, 365, 370, 5/451, 455, 457, 458

[56] References Cited

U.S. PATENT DOCUMENTS 3,983,587 10/1976 Gorran ..... 5/370

FOREIGN PATENT DOCUMENTS 787421 12/1957 United Kingdom ..... 5/349

*Primary Examiner*—Casmir A. Nunberg

[57] ABSTRACT

A watermattress construction includes upper and lower sheets of waterproof material sealed at their confronting edges to define a liquid containing bladder. A plurality of baffle panels are situated within the bladder and disposed in parallel, spaced apart relationship. Extending from each lateral edge of each baffle panel are a pair of leg panels which are buttwelded to the adjacent upper or lower sheet to define a triangular configuration therewith. The triangular assembly is easily distorted by tensile stress between the baffle and the upper or lower sheet, the stress being converted to shear stress exerted on the buttwelds joining the legs panels to the upper or lower sheets.

9 Claims, 4 Drawing Figures

BAFFLED WATERMATTRESS CONSTRUCTION

BACKGROUND OF THE INVENTION

Waterbeds have enjoyed an enormous growth in popularity in recent years, due in large part to their well deserved reputation for unsurpassed sleeping comfort. The buoyant effect of the watermattress provides equal support to all parts of the body, allowing complete relaxation.

One characteristic of the unadorned watermattress which some individuals find pleasurable and others find disturbing is the tendency of wave motion to propagate through the water in the mattress and be reflected from the sides of the bed. Typically this wave motion has a resonant frequency which is dependent upon the size of the mattress and the pressure of the water within the mattress. Many individuals who are accustomed to the solid support of more traditional bed constructions find that the motion imparted to the body by waves propagating through the mattress is distruptive to sound sleep and other bedroom pursuits.

To minimize or alleviate the wave motion problems associated with watermattresses, many modifications have been developed for watermattresses. Among these are Gel substances which may be added to the water to increase the viscosity and decrease the wave propagation, or air chambers disposed within the watermattress to absorb some of the wave energy. Another solution known to the prior art is to provide baffles within the watermattress to join the upper and lower sheets of the watermattress and minimize the displacement created by wave motion in the mattress.

The typical baffled watermattress construction known in the prior art includes an upper and lower sheet which are joined at their confronting edges to define a sealed, water retaining bladder. A plurality of baffles are usually secured within the bladder, and are joined to the upper and lower sheets with simple buttwelds. The baffle members are usually disposed in parallel relationship, although some constructions have used conical baffle members extending axially between the upper and lower sheets.

A serious drawback to the prior art baffle constructions has been the weakness of the buttweld joining the baffle member to the upper or lower sheet. It is well known by those skilled in the art of assembling watermattress of polyvinyl material that buttwelds exhibit far more shear strength than tensile strength. Unfortunately, wave motion propagating through a watermattress causes relative displacement between the upper and lower sheets of the mattress, and this in turn creates tensile stress on the butt seam joining the baffle to the upper or lower sheet. Likewise, over inflation of the mattress will also increase the tensile stress of the buttwelds.

It has been found that the buttwelds in baffled watermattress constructions tend to weaken and fail long before the failure of the edge seams which seal together the top and bottom sheets. When the butt seams fail, the baffle may tear away from the top and bottom sheet, thus reducing the wave damping action of the baffle construction. In other cases, the entire butt seam area may tear away from the top or bottom sheet, causing a catastrophic leak in the watermattress.

SUMMARY OF THE PRESENT INVENTION

The present invention generally comprises a novel construction for a baffled watermattress which exhibits increased strength, durability, and longevity. The invention also provides increased support in a watermattress, and also enhanced wave damping action.

The present invention generally comprises upper and lower sheets of vinyl or similar polymer material, the sheets being joined at corresponding confronting edges to form a sealed bladder or envelope. The manner of making the edge seam may comprise a buttweld, a lapweld, or any other technique known in the prior art. Within the bladder there is disposed a plurality of baffle panels extending between the upper and lower sheets and arrayed in parallel, spaced relationship.

Extending from the upper and lower edges of each baffle panel are a pair of leg panels which diverge angularly each from the other and are joined at their distal ends to the upper or lower sheet of bladder. The legs panels are joined to the upper or lower sheet by a buttweld to define a triangular tube having two sides defined by the leg panels and the third side defined by the portion of the upper or lower sheet which lies between the leg panels.

The triangular formation of the tube defined by the leg panels distributes the stress which exists between the baffle panel and the upper or lower sheet in such a way that the tensile stress existing between the baffle and upper or lower sheet is converted to sheer stress between the leg panel and its junction with the upper or lower sheet. This sheer stress is easily accommodated by the buttweld which joins the leg panel to the upper or lower sheet, and results in a much stronger construction than any known in the prior art.

A BRIEF DESCRIPTION OF THE DRAWING

DESCRIPTION OF THE PREFERRED EMBODIMENT

Figure 1:
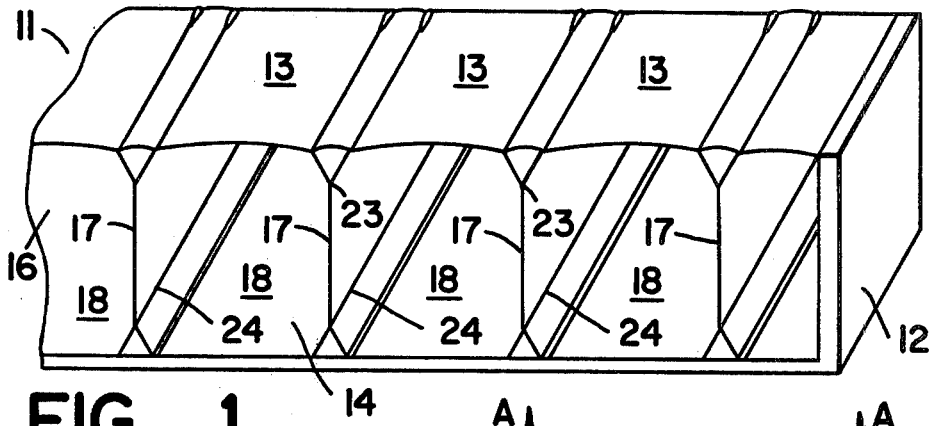
FIG. 1 is a cross sectional view of the watermattress assembly of the present invention.

With reference to FIG. 1, the present invention generally comprises a watermattress 11 which is disposed within a rigid frame 12. This is known in the prior art. The watermattress 11 includes a top sheet 13 and a bottom sheet 14, both formed of a waterproof, resilient material such as vinyl polymer or the like. The corresponding and confronting edges of the top and bottom sheets 13 and 14 are joined together in a continuous manner to form a sealed, water-retaining cavity 16 therebetween. As it is known in the prior art, the bladder 16 is filled with water through a sealable water value which is disposed in the top or bottom sheet 13 or 14.

Disposed in the cavity 16 are a plurality of baffle panels 17. The panels are arrayed in parallel, spaced apart fashion, extending between the upper and lower sheets 13 and 14. The panels 17 are joined at their upper and lower edges to the upper and lower sheets to define a plurality of adjacent chambers 18 with the bladder 16.

The baffles panel 17 serves to limit wave motion pheonomenon in the watermattress by limiting relative displacement between the upper sheet 13 and the lower sheet 14. The baffle panels, in conjunction with the chambers 18, also provide firmer support by the watermattress by permitting a higher inflation pressure within the mattress. The separate chambers 18 impede the displacement of water from one portion of the mattress to another, so that firmness of the mattress is increased while wave motion phenomena are attenuated.

Figure 2:
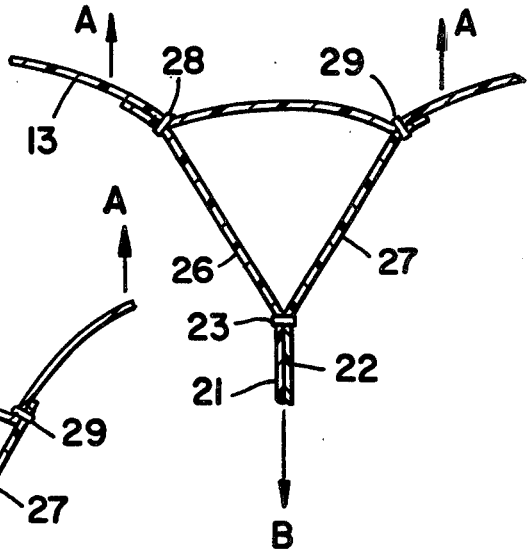
FIG. 2 is enlarged, cutaway perspective view of a portion of one baffle assembly of the present invention.

As in FIG. 2, each baffle panel 17 comprises a pair of web members 21 and 22 preferably formed of the same material as the upper and lower sheets 13 and 14. Adjacent to the upper and lower sheets and spaced apart therefrom are linear buttwelds 23 and 24, respectively, joining the two members 21 and 22 together. Thus each baffle panel 17 comprises a double thickness of the vinyl material or the like, providing enhanced strength in each baffle panel.

The distal portions 26 and 27 of the web members 21 and 22 extend from the buttwelds 23 and 24 to the upper and lower sheets respectively. The distal portions 26 and 27 diverage from their respective buttwelds, and are joined through their respective upper or lower sheets by butt seams 28 and 29, respectively. The welds 28 and 29 are spaced apart on the upper or lower sheet so that the distal portion 26 and 27 and the portion of the lower or upper sheet disposed between the welds 28 and 29 forms a triangular tube of substantially equilateral cross section.

The triangular fashion in which the baffle panels 17 are joined to the upper and lower sheets is a salient feature of the present invention, providing enhanced strength to the baffle construction, and increased durability and longevity. It is known in the prior art that buttwelds in vinyl or similar material have excellent resistance to shear stresses yet are easily susceptible to failure when placed under tensile stress. In the prior art, buttwelds have been used to join the upper and lower edges of baffle panels to the upper and lower sheets of watermattress constructions. These buttwelds have often failed due to the tensile stress exerted on these welds by relative displacement of the upper sheet with respect to the baffle members and the lower sheet.

Figure 3:
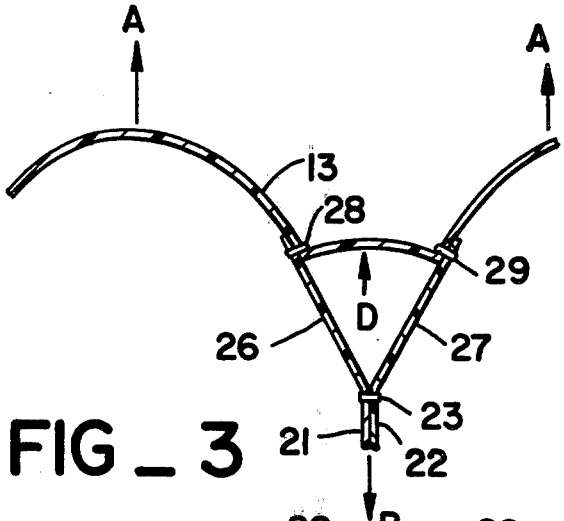
FIG. 3 is a cross sectional view of a portion of one baffle assembly of the present invention.

In the present invention, the triangular construction joining the baffle panels to the upper and lower sheets takes advantage of the shear strength of the buttwelds by transforming the tensile stress on the baffle panels 17 to shear stress on the buttwelds 28 and 29. As shown in FIG. 3, upward force exerted on the upper sheet 13, symbolized by the arrows A, is opposed by tension in the baffle member 17, symbolized by arrow B. The angular displacement of the distal portion 26 and 27 with respect to the baffle panel and to the upper sheet determine that the stress applied to the welds 28 and 29 as a result of the opposing forces A and B is primarily shear stress, rather than tensile stress. The buttwelds 28 and 29 may easily accommodate far more shear stress than tensile stress, so that the unique construction of the present invention is far less susceptible to stress related failure. Also, each baffle panel 17 is formed of a double thickness of the material forming the watermattress, so that the strength of the construction is doubly enhanced.

Figure 4:
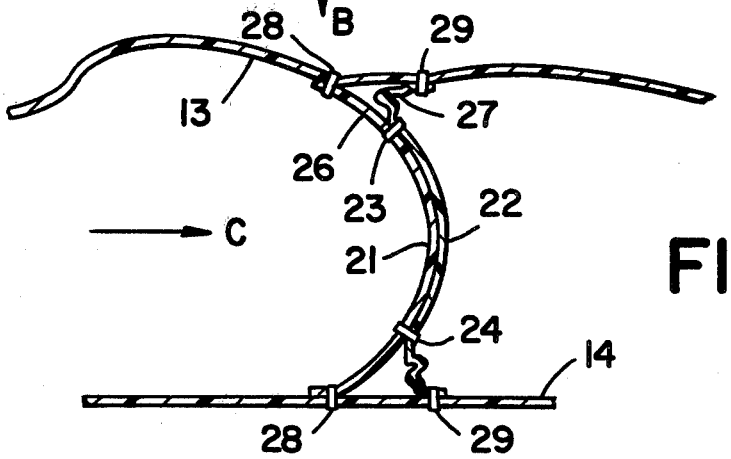
FIG. 4 is a cross sectional view as in FIG. 3, showing the effect of stress upon the baffle assembly of the present invention.

As shown in FIG. 4, lateral displacement of the water in the mattress due to wave propagation, as symbolized by the arrow C, causes a lateral shift and distortion of the baffle panel. The result is increased tension on the baffle panel, a relaxation of member 27, and increased tension on the member 26. There again, the lateral motion causes shear stress to be applied to the seam 28, and little or no tensile stress. Thus the triangular construction of the present invention is capable of withstanding greater amounts of both lateral displacement and vertical stress.

Due to the fact that the construction of the present invention is able to accommodate greater vertical stresses between the upper and lower sheets, it permits the use of greater inflation pressure within the watermattress. Thus it makes possible the provision of firmer support by the watermattress merely by filling the mattress to a greater degree. Greater inflation pressure also alleviates other typical waterbed drawbacks, such as the lack of edge support for sitting or reclining.

In the preferred embodiment of the present invention, the ends of the baffle panel 17 are not joined to the end walls of the watermattress. This construction permits the free circulation of water throughout the mattress, albeit somewhat impeded by the circuitous path that the water must follow. Furthermore, reinforced holes may be formed in the baffle panel 17, both to increase water circulation and also to permit entrance and egress of dies which are required to make the welds 23, 24, 28 and 29. These features are apparent to anyone skilled in the art, and form no part of the present invention.

I claim:

1. In a watermattress construction including upper and lower sheets joined to define a sealed, water-retaining envelope, and a plurality of baffles therein, the improvement comprising a pair of leg members having proximal ends extending from at least one upper or lower edge of each baffle to the respective upper or lower sheet, said leg members diverging angularly each from the other, and first seam means for joining the distal ends of said leg members to said respective upper or lower sheet, said leg members and said respective upper or lower sheet extending between said distal ends being disposed in triangular configuration.

2. The watermattress construction of claim 1, wherein each of said baffles includes a pair of web members, and second seam means joining said web members together.

3. The watermattress construction of claim 2, wherein said second seam means includes at least one seam extending longitudinally in each of said baffles.

4. The watermattress construction of claim 1, wherein said baffles comprise a plurality of generally planar members disposed in parallel, spaced apart relationship.

5. The watermattress construction of claim 1, wherein said first seam means includes a pair of butt seams each joining one of said legs members to said respective upper or lower sheet.

6. The watermattress construction of claim 5, wherein said leg members and said respective upper or lower sheet are disposed in triangular fashion.

7. The watermattress construction of claim 1 or 6, wherein said leg members extend the length of said baffle members.

8. The watermattress construction of claim 1, wherein each of said baffles includes a pair of web members in parallel, adjacent relationship, a pair of seams extending longitudinally in said baffle and joining said web members, each seam extending parallel to said respective upper or lower sheet and spaced apart therefrom, and second seam means for joining the distal portions of said web members to said respective upper or lower sheets in angularly diverging fashion.

9. The watermattress construction of claim 8, wherein said second seam means includes a pair of butt seams extending longitudinally and joining said distal portions to said respective sheets in triangular configuration.

* * * * *